US005917277A

United States Patent [19]

Knox et al.

[11] Patent Number: 5,917,277

[45] **Date of Patent: *Jun. 29, 1999**

[54] ELECTRON SOURCE INCLUDING A PERFORATED PERMANENT MAGNET

[75] Inventors: Andrew Knox, Kilbirnie; John Beeteson, Skelmorlie, both of United Kingdom

[73] Assignee: International Business Machines Corporation, Armonk, N.Y.

[ * ] Notice: This patent is subject to a terminal disclaimer.

[21] Appl. No.: 08/695,856

[22] Filed: Aug. 9, 1996

[30] Foreign Application Priority Data

Aug. 25, 1995 [GB] United Kingdom ..... 9517465

[51] Int. Cl.[6] ..... H01J 29/64

[52] U.S. Cl. ..... 313/495; 313/422; 313/431

[58] Field of Search ..... 313/495, 496, 313/497, 336, 309, 351, 422, 431; 315/169.1, 169.3, 169.4

[56] References Cited

U.S. PATENT DOCUMENTS

| | | | |
|---|---|---|---|
| 3,050,653 | 8/1962 | Salinger | 313/395 |
| 3,136,910 | 6/1964 | Kaplan | 313/414 |
| 4,663,559 | 5/1987 | Christensen | 313/336 |
| 4,672,272 | 6/1987 | Littwin | 315/169.1 |
| 4,763,041 | 8/1988 | Segawa | 313/496 |
| 4,835,438 | 5/1989 | Baptist et al. | 313/309 |
| 4,955,681 | 9/1990 | Sekihara et al | 313/495 |
| 5,227,691 | 7/1993 | Murai et al. | 313/497 |
| 5,270,617 | 12/1993 | Nonomura et al. | 315/169.1 |
| 5,473,222 | 12/1995 | Thoeny et al. | 315/169.1 |

FOREIGN PATENT DOCUMENTS

| | | | |
|---|---|---|---|
| A18 688 | 11/1980 | European Pat. Off. | H01J 29/80 |
| 60-093742 | 5/1985 | Japan | H01J 31/12 |
| A-60 093 742 | 5/1985 | Japan | H01J 31/12 |

*Primary Examiner*—Sandra O'Shea
*Assistant Examiner*—Michael Day
*Attorney, Agent, or Firm*—Scully, Scott, Murphy & Presser; Jay P. Sbrollini

[57] ABSTRACT

An electron source having a cathode and a permanent magnet having perforated channels extending between opposite poles of the magnet. Each channel forms electrons received from the cathode into an electron beam for guidance towards a target. The electron source has applications in a wide range of technologies, including display technology and printer technology.

32 Claims, 8 Drawing Sheets

ELECTRON SOURCE INCLUDING A PERFORATED PERMANENT MAGNET

BACKGROUND OF THE INVENTION

1. Technical Field

The present invention relates to a magnetic matrix electron source and methods of manufacture thereof.

A magnetic matrix electron source of the present invention is particularly although not exclusively useful in display applications, especially flat panel display applications. Such applications include television receivers and visual display units for computers, especially although not exclusively portable computers, personal organizers, communications equipment, and the like. Flat panel display devices based on a magnetic matrix electron source of the present invention will hereinafter by referred to as Magnetic Matrix Displays.

2. Prior Art

Conventional flat panel displays, such as liquid crystal display panels, and field emission displays, are complicated to manufacture because they each involve a relatively high level of semiconductor fabrication, delicate materials, and high tolerances.

SUMMARY OF THE INVENTION

In accordance with the present invention, there is provided an electron source comprising cathode means and a permanent magnet perforated by a plurality of channels extending between opposite poles of the magnet wherein each channel forms electrons received from the cathode means into an electron beam for guidance towards a target.

In a preferred embodiment of the present invention, the electron source comprises grid electrode means disposed between the cathode means and the magnet for controlling flow of electrons from the cathode means into the channels.

The channels are preferably disposed in the magnet in a two dimensional array of rows and columns.

Preferably, the grid electrode means comprises a plurality of parallel row conductors and a plurality of parallel column conductors arranged orthogonally to the row conductors, each channel being located at a different intersection of a row conductor and a column conductor.

The grid electrode means may be disposed on the surface of the cathode means facing the magnet. Alternatively, the grid electrode means may be disposed on the surface of the magnet facing the cathode means.

The cathode means may comprise a cold emission device such as a field emission device. Alternatively, the cathode means may comprise a photocathode. In some embodiments of the present invention, the cathode may comprise a thermionic emission device.

In a particularly preferred embodiment of the invention, each channel has a cross-section which varies in shape and/or area along its length. In a preferred embodiment of the present invention, each channel is tapered, the end of the channel having the largest surface area facing the cathode means.

The magnet preferably comprises ferrite. In some embodiments of the present invention, the magnet may a comprise a ceramic material. In preferred embodiments of the present invention, the magnet may also comprise a binder. The binder may be organic or inorganic. Preferably, the binder comprises silicon dioxide.

In preferred embodiments of the present invention, the channel is quadrilateral in cross-section. In particularly preferred embodiment of the present invention, the cross section is either square or rectangular. The corners and edges of each channel are preferably radiussed.

The magnet may comprise a stack of perforated laminations, the perforations in each lamination being aligned with the perforations in an adjacent lamination to continue the channel through the stack, the 1 stack being arranged such that like poles of the laminations face each other. Spacers may be inserted between the laminations to give the stack an improved lens effect.

An insulating layer may be deposited on at least one surface of the magnet to reduce flashovers.

Preferred embodiments of the present invention comprise anode means disposed on the surface of the magnet remote from the cathode for accelerating electrons through the channels.

The anode means preferably comprises a plurality of anodes extending parallel to the columns of channels, the anodes comprising pairs of anodes each corresponding to a different column of channels, each pair comprising first and second anodes respectively extending along opposite sides of the corresponding column of anodes, the first anodes being interconnected and the second anodes being interconnected. Preferably, the anodes partially surround the channels.

Particularly preferred embodiments of the present invention comprise means for applying a deflection voltage across the first and second anodes to deflect electron beams emerging from the channels.

Viewing the present invention from another aspect there is now provided a display device comprising: an electron source of the kind hereinbefore described; a screen for receiving electrons from the electron source, the screen having a phosphor coating facing the side of the magnet remote from the cathode; and means for supplying control signals to the grid electrode means and the anode means to selectively control flow of electrons from the cathode to the phosphor coating via the channels thereby to produce an image on the screen.

Viewing the present invention from yet another aspect, there is provided a display device comprising: an electron source of the kind hereinbefore described; a screen for receiving electrons form the electron source, the screen having a phosphor coating facing the side of the magnet remote from the cathode, the phosphor coating comprising a plurality of groups of different phosphors, the groups being arranged in a repetitive pattern, each group corresponding to a different channel; means for supplying control signals to the grid electrode means and the anode means to selectively control flow of electrons from the cathode to the phosphor coating via the channels; and deflection means for supplying deflection signals to the anode means to sequentially address electrons emerging from the channels to different ones of the phosphors for the phosphor coating thereby to produce a color image on the screen. The phosphors preferably comprise Red, Green, and Blue phosphors.

The deflection means is preferably arranged to address electrons emerging from the channels to different ones of the phosphors in the repetitive sequence Red, Green, Red, Blue, . . . . Alternatively, the deflection means may be arranged to address electrons emerging from the channels to different ones of the phosphors in the repetitive sequence Red, Green, Red, Blue, . . . .

Preferred examples of display devices of the present invention comprise a final anode layer disposed on the phosphor coating.

The screen may be arcuate in at least one direction and each interconnection between adjacent first anodes and between adjacent second anodes comprises a resistive element.

Particularly preferred examples of display devices of the present invention comprise means for dynamically varying a DC level applied to the anode means to align electrons emerging from the channels with the phosphor coating on the screen.

Some example of the display devices of the present invention may comprise an aluminum backing adjacent the phosphor coating.

It will be appreciated that the present invention extends to a computer system comprising: memory means; data transfer means for transferring data to and from the memory means; processor means for processing data stored in the memory means; and a display device comprising the electron source as hereinbefore described for displaying data processed by the processor means.

It will further be appreciated that the present invention extends to a print-head comprising an electron source as hereinbefore described. Still further, it will be appreciated that the present invention extends to document processing apparatus comprising such a print-head, together with means for supplying data to the print-head to produce a printed record in dependence on the data.

Viewing the present invention from a further aspect, there is provided a triode device comprising: cathode means; a permanent magnet perforated by a plurality of channels extending between opposite poles of the magnet wherein each channel forms electrons received from the cathode means into an electron beam; grid electrode means disposed between the cathode means and the magnet for controlling flow of electrons from the cathode means into the channels; and, anode means disposed on the surface of the magnet remote from the cathode for accelerating electrons through the channels.

Viewing the present invention from still another aspect, there is provided a method for making an electron source, comprising: forming a layer of powder comprising ferrite in a mold; moving a die comprising an array of pins relative to the mold in such a manner that the pins perforate the powder layer as the die compresses the powder in the mold; fusing the perforated powder layer to form a perforated block; and, magnetizing the perforated block to produce a permanent magnet.

The method may comprise mixing the ferrite with a binder prior to forming the powder layer. Preferably, the binder comprises glass particles.

Preferably, the method comprises vibrating the pins as the die is moved relative to the mold.

The fusing and magnetizing steps preferably include heating the powder layer.

The method may comprise depositing anode means on a perforated face of the magnet.

Preferably, the method comprises depositing control grid means on the face of the magnet remote from the face carrying the anode means.

At least one of the step of depositing the anode means and the step of depositing the control grid means may comprise photolithography.

Viewing the present invention from still another aspect, there is provided a method for making a display device comprising: making an electron source according to the method hereinbefore described; positioning a phosphor coated screen adjacent the face of the magnet carrying the anode means; and, evacuating spaces between the cathode means and between the magnet and the magnet and the screen.

Viewing the present invention from yet another aspect, there is provided a method for addressing pixels of a display screen having a plurality of pixels, each pixel having successively first, second, and third sub-pixels in line, the method comprising: generating a plurality of electron beams, each electron beam corresponding to a different one of the pixels; and, deflecting each electron beam to repetitively address the sub-pixels of the corresponding pixel in the sequence second pixel, first pixel, second pixel, third pixel.

BRIEF DESCRIPTION OF THE DRAWINGS

Preferred embodiments of the present invention will now be described, by way of example only, with reference to the accompanying drawings, in which.

5

DETAILED DESCRIPTION OF THE PREFERRED EMBODIMENTS OF THE INVENTION

Figure 1:
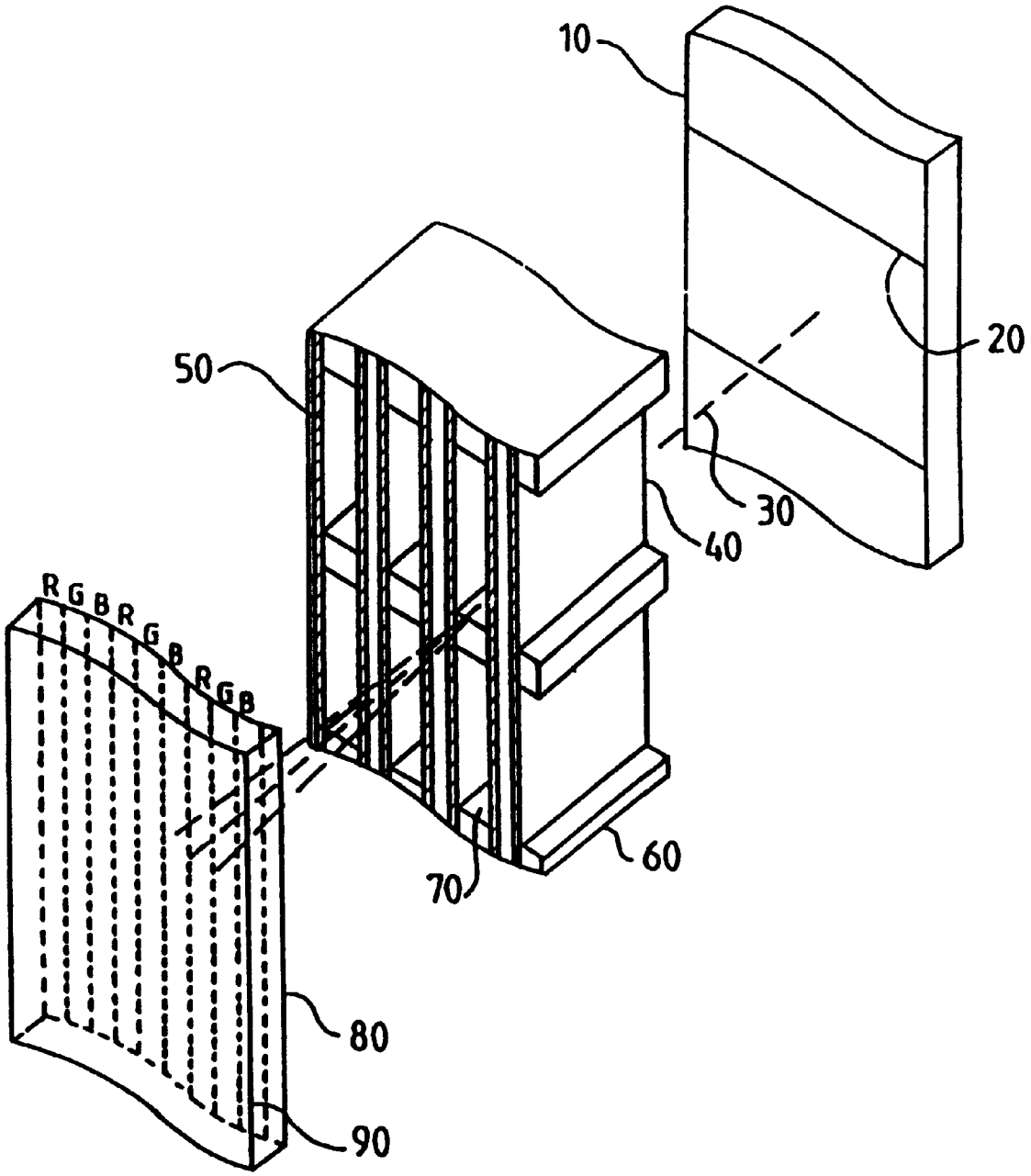
FIG. 1 is an exploded diagram of display apparatus of the present invention.

Referring first to FIG. 1, a color magnetic matrix display of the present invention comprises: a first glass plate 10 carrying a cathode 20 and a second glass plate 90 carrying a coating of sequentially arranged red, green and blue phosphor stripes 80 facing the cathode 20. The phosphors are preferably high voltage phosphors. A final anode layer (not shown) is disposed on the phosphor coating 80. A permanent magnet 60 is disposed between glass plates 90 and 10. The magnet is perforated by a two dimension matrix of perforation or "pixel wells" 70. An array of anodes 50 are formed on the surface of the magnet 60 facing the phosphors 80. For the purposes of explanation of the operation of the display, this surface will be referred to as the top of the magnet 60. There is a pair of anodes 50 associated with each column of the matrix of pixel wells 70. The anode of each pair extend along opposite sides of the corresponding column of pixel wells 70. A control grid 40 is formed on the surface of the magnet 60 facing the cathode 10. For the purposes of explanation of the operation of the display, this surface will be referred to as the bottom of the magnet 60. The control grid 40 comprises a first group of parallel control grid conductors extending across the magnet surface in a column direction and a second group of parallel control grid conductors extending across the magnet surface in a row direction so that each pixel well 70 is situated at the intersection of different combination of a row grid conductor and a column grid conductor. As will be described later, plates 10 and 90, and magnet 60 are brought together, sealed and then the whole is evacuated. In operation, electrons are released from the cathode and attracted towards control grid 40. Control grid 40 provides a row/column matrix addressing mechanism for selectively admitting electrons to each pixel well 70. Electrons pass through grid 40 into an addressed pixel well 70. In each pixel well 70, there is an intense magnetic field. The pair of anodes 50 at the top of pixel well 70 accelerate the electrons through pixel well 70 and provide selective sideways deflection of the emerging electron beam 30. Electron beam 30 is then accelerated towards a higher voltage anode formed on glass plate 90 to produce a high velocity electron beam 30 having sufficient energy to penetrate the anode and reach the underlying phosphors 80 resulting ion light output. The higher voltage anode may typically be held at 10 kv.

Figure 2A:
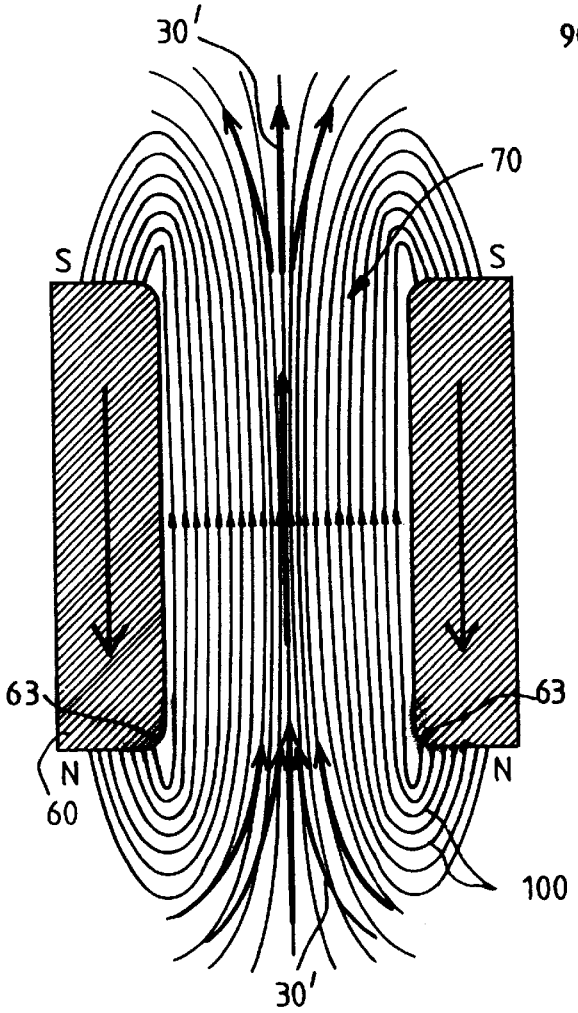
FIG. 2A is a cross-section view through a well of an electron source of the present invention to show magnetic field orientation.
Figure 2B:
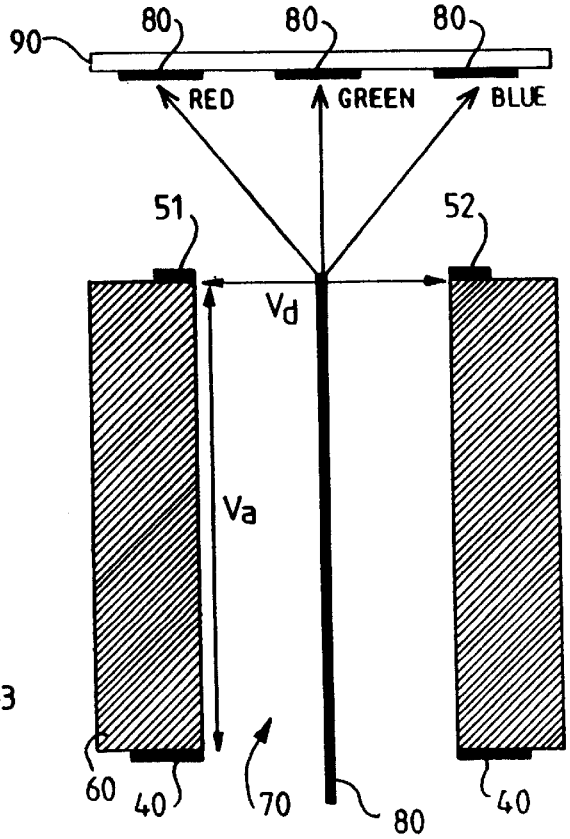
FIG. 2B is a cross-section view through a well of an electron source of the present invention to show electric field orientation.

What follows is a description of the device physics associated with a display of the present invention, in which the following quantities and equations are used:

Charge on an electron: $1.6\times10^{-19}$C
Energy of 1 electron-volt: $1.6\times10^{-19}$J
Rest mass of 1 electron: $9.108\times10^{-31}$Kg
Electron velocity: $v=(2eV/m)^{1/2}$ m/s
Electron kinetic energy: $mv^2/2$
Electron momentum: mv
cyclotron frequency: f=qB/(2.pi.m) Hz FIG. 2A shows a simplified representation of magnetic fields with associated electron trajectories passing though pixel well 70. FIG. 2B shows a representation of electrostatic fields with associated electron trajectories passing through pixel well 70. An electrostatic potential is applied between the top and bottom of magnet 60 which has the effect of attracting electrons through the magnetic field shown at 100. Cathode 20 may be a hot cathode or a field emission tip array or other convenient source of electrons. The corners and edges of the well 70 may be radiussed as shown at 63.

At the bottom of the magnetic field 100, by the entrance to pixel well 70, the electron velocity is relatively low (leV above the cathode work function represents an electron velocity of around $6\times10^5$ m/s). Electrons 30' in this region can be considered as forming a cloud, with each electron traveling in its own random direction. As the electrons are attracted by the electrostatic field their vertical velocity increases. If an electron is moving in exactly the same direction as the magnetic field 100 there will be no lateral force exerted upon it. The electron will therefore rise through the vacuum following the electric field lines. However, in the more general case the electron direction will not be in the direction of the magnetic field.

Referring now to FIG. 2B, magnetic force acting on a moving electron is perpendicular to both the magnetic field and the velocity of the electron (Flemings right hand rule or $F=e(E+v\times B)$). Thus, in the case of a uniform magnetic field only, the electron will describe a circular path. However, when the electron is also being accelerated by an electric field, the path becomes helical with the diameter of the helix being controlled by the magnetic field strength and the electrons x,y velocity. The periodicity of the helix is controlled by the electrons vertical velocity. A good analogy of this behavior is that of a cork in a whirlpool or dust in a tornado.

It is proposed that an electron drifts into the magnetic field 100 with a 3 dimensional velocity v. There are non-zero x, y, and z velocity components where x and y are in the plane of the magnet 60 and z is upwards through magnet 60. Assume the velocity in the plane $v_{x,y}$ is $6\times10^5$ m/s.

The radius of the helix i n the xy plane is given by r=mv/qB. Assuming a magnetic field intensity of B=0.5 T at the center of well 70, the helix radius is about $6.8\times10^{-6}$ m. At the top of well 70, the field intensity has dropped to B/2, doubling the radius. The helix radius continues to increase as the electron moves away from well 70 towards phosphor 80. The magnetic field intensity may drop rapidly the surface of magnet 60, causing the electron beam 30 to become divergent. However, the acceleration of the electrons towards the final anode will attenuate this effect.

By way of summary, electrons enter magnetic field B 100 at the bottom of magnet 60, accelerate through well 70 in magnet 60, and emerge at the top of magnet 60 in a narrow but diverging beam.

Considering now the display as whole rather than a single pixel, the magnetic field B 100 shown in FIG. 2A is formed by a channel or pixel well 70 through a permanent magnet 60. Each pixel requires a separate pixel well 70. Magnet 60 is the size of the display area and is perforated by a plurality of pixel wells 70.

Figure 3:
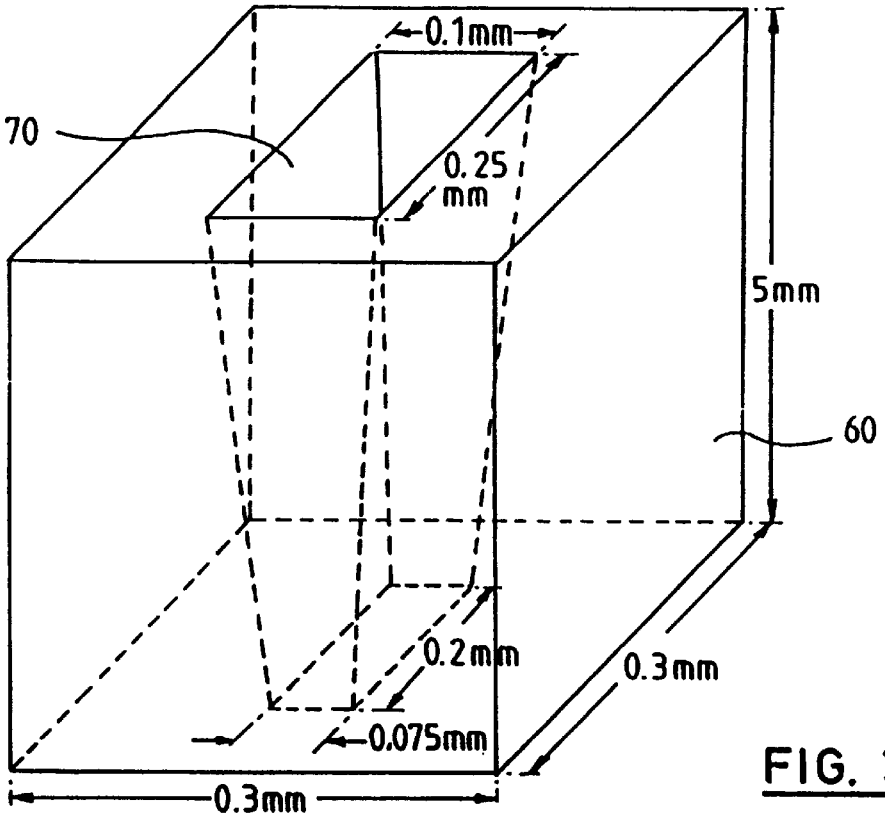
FIG. 3 is an isometric view of a well of an electron source of the present invention.

Referring now to FIG. 3, the magnetic field intensity in well 70 is relatively high; the only path for the flux lines to close is either at the edge of magnet 60 or through wells 70. Wells 70 may be tapered, with the narrow end of the taper adjacent cathode 20. It is in this region that the magnetic field is strongest and the electron velocity lowest. Thus efficient electron collection is obtained.

Figure 4A:
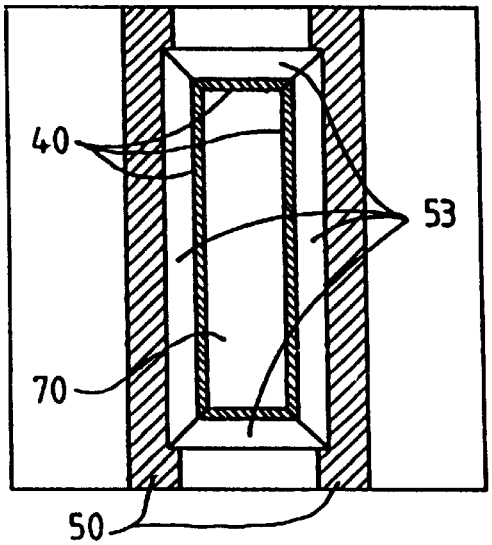
FIG. 4A is a plan view of a well of an electron source of the present invention.
Figure 4B:
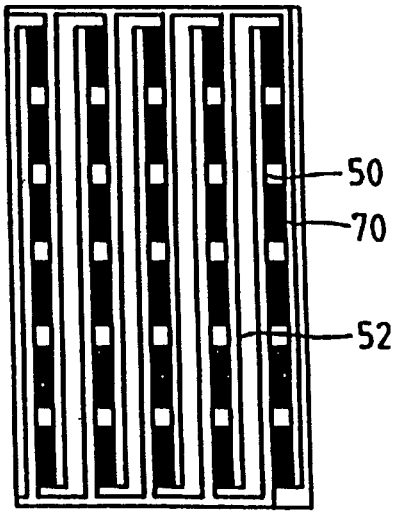
FIG. 4B is a plan view of a plurality of wells of an electron source of the present invention.

Referring back to FIG. 2B, electron beam 30 is shown entering an electrostatic field E. As an electron in the beam moves through the field, it gains velocity and momentum. The significance of this increase in the electrons momentum will be discussed shortly. When the electron nears the top of magnet 60, it enters a region influenced by deflection anodes 50. Assuming an anode voltage of 1 kV and a cathode voltage of OV, the electron velocity at this point is $1.875\times 10^7$ m/s or approximately 6% of the speed of light. At the final anode, where the electron velocity is $5.93\times10^7$ m/s or 0.2 c, since the electron has then moved through 10 kV. Anodes 51 and 52 on either side of the exit from the pixel well 70 may be individually controlled. Referring now to FIGS. 4A and 4B, anodes 51 and 52 are preferably arranged in a comb configuration in the interests of easing fabrication. Anodes 51 and 52 are separated from well 70 and grid 40 by insulating regions 53. There are four possible states for anodes 51 and 52, as follows.

1. Anode 51 is OFF; Anode 52 is OFF: In this case there is no accelerating voltage $V_a$ between the cathode 20 and the anodes 51 and 52. This state is not used in normal operation of the display.
2. Anode 51 is ON; Anode 52 is ON: In this case there is accelerating voltage $V_a$, symmetrically about the electron beam. The electron beam path is unchanged. When leaving the control anode region the electrons continue until they strike the Green phosphor.
3. Anode 51 is OFF; Anode 52 is ON: In this case there is an asymmetrical control anode voltage $V_d$. The electrons are attracted towards the energized anode 52 (which is still providing an accelerating voltage relative to the cathode 20). The electrons beam is thus electrostatically deflected towards the Red phosphor.
4. Anode 51 is ON; Anode 52 is OFF: This is the opposite to 3. above. In this case, the electron beam is deflected towards the Blue phosphor.

It will be appreciated that other sequences of phosphors may be deposited on the screen with corresponding data re-ordering.

It should also be appreciated that the above deflection technique does not change the magnitude of the electron energy.

As described above, electron beam 30 is formed as electrons move through magnet 60. The magnetic field B 100, although decreasing in intensity still exists above the magnet and in the region of anodes 50. Thus, operation of anodes 50 also requires that they have sufficient effect to drive electron beam 30 at an angle through magnetic field B 100. The momentum change of the electron between the bottom and top of well 70 is of the order of 32× (for a 1 KV anode voltage). The effect of the divergent magnetic field B 100 may be reduced between the bottom and top by a similar amount.

Individual electrons tend to continue traveling in a straight line. However, there are three forces tending to disperse electron beam 30, as follows:

1. The diverging magnetic field B 100 tends to cause electron beam 30 to diverge due to the $v_{xy}$ distribution;
2. The electrostatic field E tends to deflect electron beam 30 towards itself; and,
3. Space charge effects within beam 30 itself cause some divergence.

Also, the helical motion of an individual electron is accentuated by the electrostatic deflection because it's velocity in the x,y plane has been increased significantly. Low deflection angles minimize this.

Figure 5:
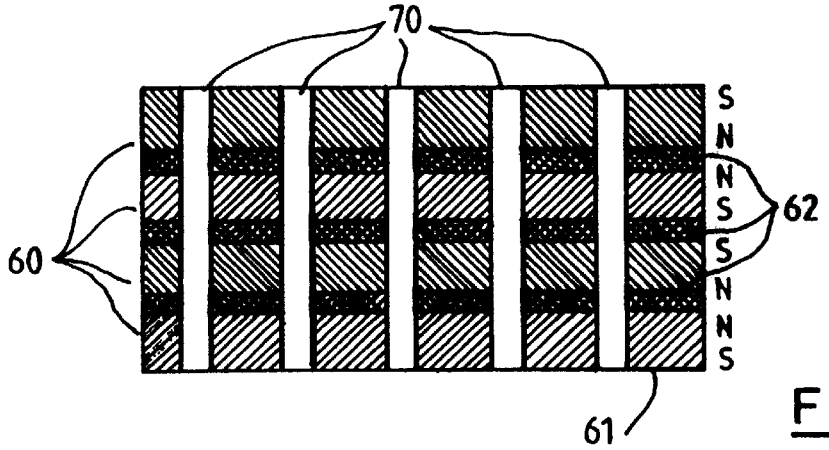
FIG. 5 is a cross section of a stack of magnets of an electron source of the present invention.

Referring now to FIG. 5, in a modification to the example of the preferred embodiment of the present invention hereinbefore described, magnet 60 is replaced by a stack 61 of magnets 60 with like poles facing each other. This produces a magnetic lens in each well 70, thereby aiding beam collimation prior to deflection. This provides additional electron beam focusing. Furthermore, providing the stack 61 consists of one or more pairs of magnets, the helical motion of the electrons is canceled. In some embodiments of the present invention, spacers 62 may be inserted between magnets 60 to improve the lens effect of stack 61.

What follows is a simplified explanation of electrostatic deflection by way of background only to the geometry of a magnetic matrix display device of the present invention. The explanation is formed around a calculation of the deflection angle of electron beam 30. This calculation is made without considering the effects of magnetic field divergence and electrostatic fringing effects at the edges of deflection anodes 50. It should be appreciated that the electrostatic field extend beyond anodes 50 and that these fields can have a significant effect on the actual deflection. The accelerating effect of the final anode is also ignored for the purpose of this explanation.

Figure 6A:
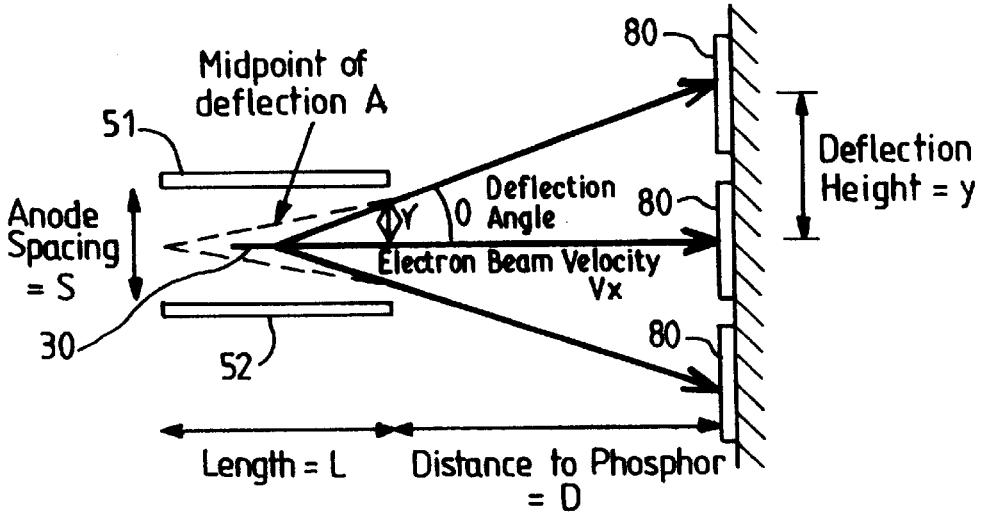
FIG. 6A is a simplified side view of a well of an electron source of the present invention.

FIG. 6A shows a simplified electrostatic deflection system together with geometries relevant thereto.

The electric field intensity $E=(V_{anode\ 51}-V_{anode\ 52})/S$, where S is the anode spacing.

Thus, force on the electron=eE, and electron acceleration $a_y=eE/m=eV_A/ml$.

The horizontal electron velocity $V_x$ remains constant, so the time for which the electron is between the deflection anodes 50 is $t=L/v_x$.

The vertical velocity attained during this period is $v_y=a_y t$ and the vertical displacement is $y'=\frac{1}{2}.a_y^2$.

On exit from the deflection field the electron velocity v makes an angle Q with the x axis such that $\tan Q=v_y/v_x$. Although when passing between deflection anodes 50 the electron path is parabolic, it can be represented as a vector originating at the midpoint of deflection anodes 50, A, making an angle Q with the x axis. Thus, the collision of electron beam 30 with the phosphor 80 occurs at distance y from the x axis, where $\tan Q=y/(D+L/2)$. Rearranging this gives:

$$y=(V_2/V_1)(L/2S.\ (D+L/2))$$

where $V_1$ is the final anode voltage and $V_2$ is the deflection voltage.

Figure 6B:
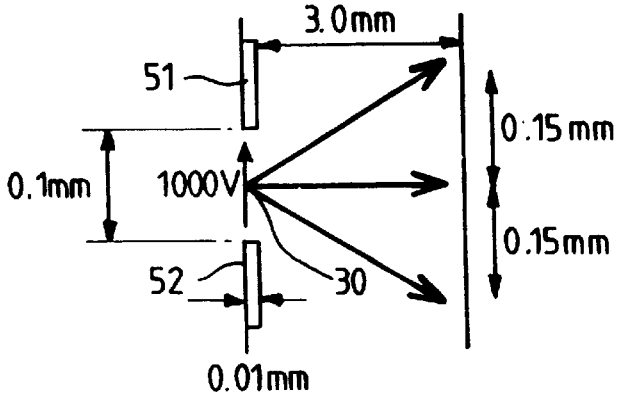
FIG. 6B is another simplified side view of a well of an electron source of the present invention.

FIG. 6B shows the geometry determined in accordance with the above formulae to provide a deflection of +/−0.15 mm. The important parameters for the purpose of the above calculation are: deflection anode thickness=0.01 mm; distance between phosphor 80 and the top of deflection anode 50=3 mm; pixel well width=0.1 mm; and, the phosphor and deflection anode voltage is equal. The deflection of +/−0.15 mm provides a deflection of electron beam 30 onto the red and blue phosphors, hence providing the required degree of beam indexing.

For the purpose of the above calculations, anodes 50 were assumed to be at the same potential as phosphors 80 so that there is a constant electric field between the two. This arrangement is acceptable if low voltage phosphors are used. However, in preferred embodiments of the present invention, high voltage phosphors are used, requiring the final anode to be at a much higher potential than deflection anodes 50. Thus electron beam 30 will continue to accelerate towards the final anode after leaving the vicinity of anodes 50. This in turn causes a change in the path of the electron before it hits phosphor 80. For a final anode voltage of the order of 10 kV, the electrical stresses involved are such that the deflection anode voltages cannot be operated at this level, apart from the practical difficulties associated with operating anodes 50 at this potential. Specifically, at 10 kV on anodes 50, a flash-over may become a sustained arc. However, the accelerating electric field between anodes 50 and the final anode reduces the deflection effect of anodes 50. Therefore, the length of anodes 50 can be increased without risk of significant numbers of electrons colliding with them. This reduces the susceptibility of the display to manufacturing tolerances during deflection anode fabrication.

Returning now to FIG. 1 and magnet 60 in particular, as mentioned earlier, perforations 70 in magnet 60 allow the closing of flux line, thus providing intense fields within well 70. It is desirable for magnet 60 to be relatively cheap to construct; to be non-conductive, thereby allowing it to from a substrate for conductive track fabrication; to be mechanically robust; to be thermally stable; not to be too massive; and, to be susceptible to fabrication to overall display dimensions.

At least some of the above properties may be met by magnet 60 being formed from solid ferrite material. Perforations can be formed in such material by press tools, laser drilling, diamond drilling, or water jetting. Solid ferrite sheet magnets are typically formed from a wet slurry which is pressed in a mold to remove as much water as possible while a magnetic field is applied to orient the particles in the their preferred direction of magnetization. After pressing, magnet 60 is removed from the mold and allowed to dry before passing through a sintering tunnel at 1000 degrees C. Problems that can occur with this process are curling, cracking, and crinkling of the sheet. More importantly however, the finished sheet material is relatively fragile. The fragility of the material may be overcome by cladding one or both surfaces of magnet 60 with a non-magnetic, non-conductive supporting layer prior to depositing any tracks on magnet 60.

There are also flexible magnets available. These magnets are typically made by mixing 85% by weight of ferrite particles with an organic polymer binder such as Dupont nitrile. The mixture is then rolled or extruded whilst a magnetic field is applied. This process can provide a relatively low cost magnet of the dimensions commensurate with a typical display screen. Flexible magnets can be formed with magnetic field strength of up to 2600 Gauss, about equal to middle grades of solid ferrite magnets, but more than adequate for providing the pixel well effect hereinbefore described. However, the organic binder is not suitable for use in a vacuum environment containing high energy electrons.

In a particularly preferred embodiment of the present invention, magnet 60 is formed from a mixture of ferrite particles in an inorganic binder. The mixture is outgassed and poured into a mold having a plurality of die pins to form pixel wells 70. In an especially preferred embodiment of the present invention, the ferrite particles are mixed with glass particles and placed in the mold. The mold is then heated to melt the glass whilst an orienting magnetic field is applied. The mold is left in place fro a short time necessary for the glass-ferrite mixture to set. This approach is preferred to the solid ferrite magnet approach described above because it permits a large area sheet magnet to be made without high capital investment in tooling and presses; it stabilizes the ferrite surfaces; it gives strong mechanical support and reduces brittleness; it provides a good surface for photolithographic deposition of anodes 50; and, it provides a perfect surface for glass/glass sealing.

Figure 7A:
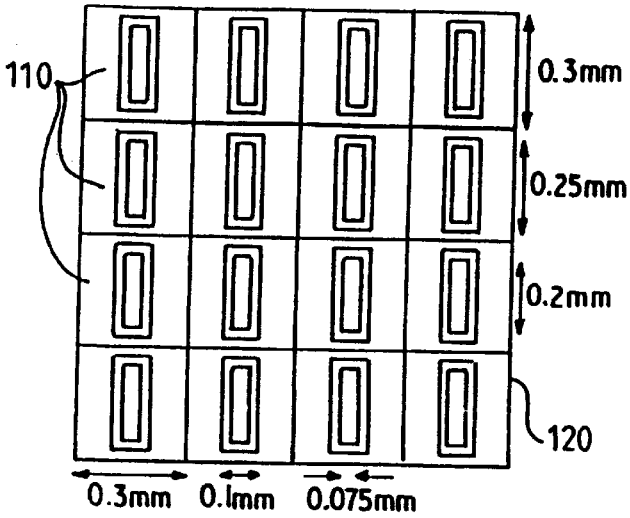
FIG. 7A is a plan view of a die for making a magnet for an electron source of the present invention.
Figure 7B:
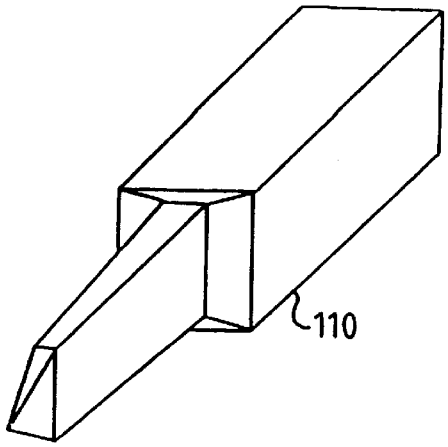
FIG. 7B is an isometric view of a pin of the die.
Figure 9A:
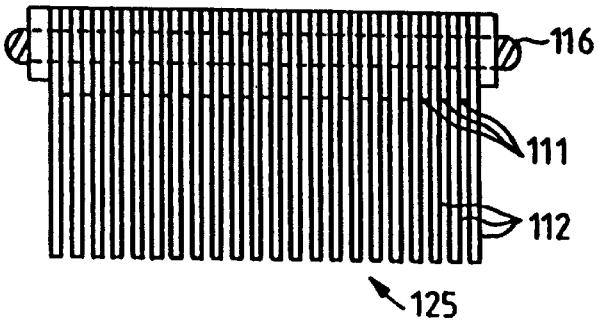
FIG. 9A is a side view of an alternative die for making a magnet for an electron source of the present invention.
Figure 9B:
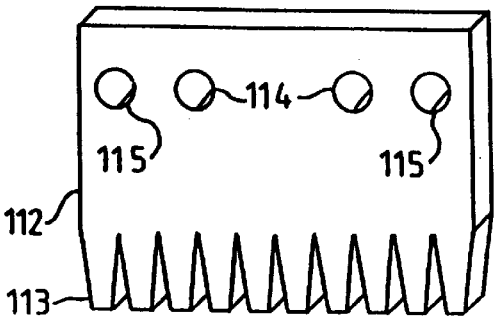
FIG. 9B is an isometric view of an element of the alternative die.

It will be appreciated that conventional punching or machining techniques are not preferred for production of pixel wells 70 in magnet 60 because the thickness of magnet 60 is much larger than the diameter of the wells. Instead, referring to FIGS. 7A and 7B, in a preferred embodiment of the present invention, pixel wells 70 are each formed by a different pin 110 in an array 120 of pins supported within a press arrangement. Pins 110 may be formed in a one piece die. The die may be formed by machining the pin profiles into single piece of steel. This die is particularly useful for manufacturing small, low resolution display as high numbers of pins 110 may be difficult to machine and pin size may be limited. Furthermore, breakage of a single pin 110 may result in loss of the complete die. Alternatively, in other embodiments of the present invention, each pin 110 is individually machined and then supported with the rest of pins 110 in the array 120 by a carrier. The advantage with this arrangement is that a broken pins can be easily replaced in the carrier. This arrangement is particularly useful for medium to high resolution displays, the die requiring of the order of 750,000 pins for example. Referring to FIG. 9, in further embodiments of the present invention, the die 125 may be formed by a laminar structure of alternating first and second plates, 112 and 111, clamped together. The first plates 112 are precision etched to produce an array of teeth 113 along one side. The second plates 111 act as spacers disposed between adjacent toothed plates 112. Plates 111 and 112 are held together via clamp holes 114 through which a precision dowel 116 is inserted. Guide holes 115 permit the plates to be aligned prior to clamping. Die 125 is especially useful for manufacturing small very high resolution displays for projection applications.

Figure 8:
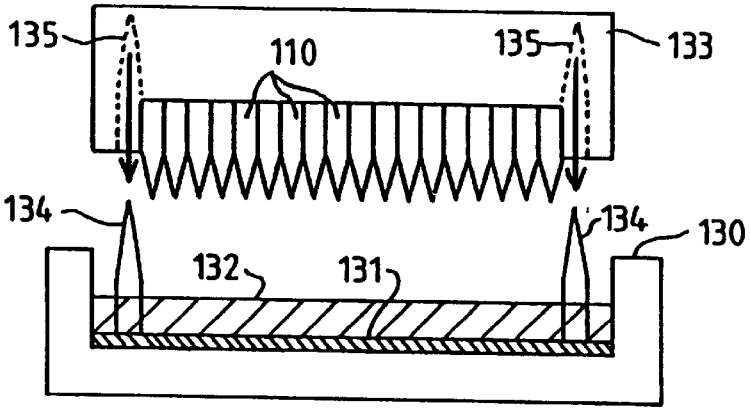
FIG. 8 is a cross section of apparatus for making a magnet for an electron source of the present invention.

Turning now to FIG. 8, in a preferred embodiment of the present invention magnet 60 is formed by manufacturing apparatus comprising a mold 130 into which a compliant base 131, formed from relatively hard rubber for example, is laid. Either powdered ferrite 132, or preferably a mixture of powdered ferrite and glass, is then deposited in the mold 130. This process may be performed in a vacuum or otherwise low pressure environment to prevent outgassing of magnet 60. A carrier 133 containing the array of pins 110 is then lowered into mold 130. As carrier 133 is lowered a set of locating studs 134 upwardly facing from mold 130 engage receiving holes 135 in carrier 133. Engagement of studs 134 and holes 135 serve to align pins 110 with powder 132 below and also to later provide a datum for subsequent photolithography (see later). It will be appreciated that the depth to which powder 132 is deposited in mold 130 depends on the desired magnet thickness, compression pressure and pin geometry. As carrier 133 is lowered further, pins 110 start to enter powder 132. Initially pins 110 displace powder 132 as they move towards base 131. However, pins 110 are tapered and the total volume available for powder 132 gradually decreases. The powder is thus compacted under increasing pressure. Finally, pins 110 penetrate the bottom of powder 132 and pass into base 131, thus completing pixel wells 70. Meanwhile, the desired compression of powder 132 is achieved. It will be appreciated that the pressure within mold 130 is uniform (assuming uniform powder deposition) and that there is no lateral deflection force on pins 110. Thus the X-Y geometry of the structure is not distorted.

To aid compression of powder 132, pins 110 may be driven into powder 132 with high frequency vibrations. This aids packing of powder 132 as pins 110 pass through it and also improves the mechanical integrity of the completed structure. After formation, the ferrite block may be removed from mold 130 and passed to a sintering process.

Provided the thermal expansion coefficient of pins 110 is not too great, pins 110 may be left in mold 130 during sintering to ensure none of pixel wells 70 collapse. The tapering of pins 110 assists in tool removal. After tool removal, the magnet faces can be ground to improve flatness and then cleaned. Where powder 132 includes glass, mold 130 is heated to melt the glass and then left to cool until the molten mixture solidifies. Where powder 132 comprises ferrite without an accompanying binder, an insulating layer 166, as show in FIG. 2B, may be deposited on the magnet surfaces to prevent flashovers in use.

Pixel wells 70 near the edge of magnet 60 may be influenced by the closing of flux lines at the magnet boundary. This may reduce electron collection efficiency. Therefore, in preferred embodiments of the present invention, magnet 60 is formed with a peripheral dead band which is left unpopulated by pixel wells 70. The dead band provides sites for driver chip placement and connection tabs, as well as improving mechanical rigidity and strength. To prevent shock damage to the magnetic field, magnet 60 is preferably supported by a compliant mounting system such as a resilient edge seal or the like. It will be appreciated that a permanent DC magnetic field radiates from magnet 60. However, the arrangement does not contravene emission standards such as MPR II because the field is not time-varying.

As mentioned earlier, the display has cathode means 20, grid or gate electrodes 40, and an anode. The arrangement can thus be regarded as a triode structure. Electron flow from cathode means 20 is regulated by grid 40 thereby controlling the current flowing to the anode. It should be noted that the brightness of the display does not depend on the velocity of the electrons but on the quantity of electrons striking phosphor 80.

As mentioned above, magnet 60 acts as a substrate onto which the various conductors required to form the triode are deposited. Deflection anodes 50 are deposited on the top face of magnet 60 and control grid 40 is fabricated on the bottom surface of the magnet 60. Referring back to FIG. 3, it will be appreciated that the dimensions of these conductors are relatively large compared with those employed in current flat panel technologies such as liquid crystal or field emission displays for example. The conductors may advantageously be deposited on magnet 60 by conventional screen printing techniques, thereby leading to lower cost manufacture compared with current flat panel technologies.

Referring back to FIG. 4, deflection anodes 50 are placed on either side of well 70. In the example hereinbefore described, an anode thickness of 0.01 mm provided acceptable deflection. However, larger dimensions may be used with lower deflection voltages. Deflection anodes 50 may also be deposited to extend at least partially into pixel well 70. It will be appreciated that, in a monochrome example of a display device of the present invention, anode switching or modulation is not required. The anode width is selected to avoid capacitive effects introducing discernable time delays in anode switching across the display. Another factor affecting anode width is current carrying capacity, which is preferably sufficient that a flash-over doe not fuse adjacent anodes together and thus damage the display.

In an embodiment of the present invention preferred for simplicity, beam indexing is implemented by alternately switching drive voltages to deflection anodes 50. Improved performance is obtained in another embodiment of the present invention by imposing a modulation voltage on deflection anodes 50. The modulation voltage waveform can be one of many different shapes. However, a sine wave is preferable to reduce back emf effects due to the presence of the magnetic field.

Cathode means 20 may include an array of field emission tips or field emission sheet emitters (amorphous diamond or silicon for example). In such cases, the control grid 40 may be formed on the field emission device substrate. Alternatively, cathode means 20 may include plasma or hot area cathodes, in which cases control grid 40 may be formed on the bottom surface of the magnet as hereinbefore described. An advantage of the ferrite block magnet is that the ferrite block can act as a carrier and support for all the structures of the display that need precision alignment, and that these structures can be deposited by low grade photolithography or screen printing. In yet another alternative embodiment of the present invention, cathode means 20 comprises a photocathode.

As mentioned above, control grid 40 controls the beam current and hence the brightness. In some embodiments of the present invention. The display may be responsive to digital video alone, i.e.: pixels either on or off with no grey scale. In such cases, a single grid 40 provides adequate control of beam current. The application of such displays are however limited and, generally, some form of analog, or grey scale, control is desirable. Thus, in other embodiments of the present invention, two grids are provided; one for setting the black level or biassing, and the other for setting the brightness of the individual pixels. Such a double grid arrangement may also perform matrix addressing of pixels where it may be difficult to modulate the cathode.

A display of the present invention differs from a conventional CRT display in that, whereas in a CRT display only one pixel at a time is lit, in a display of the present invention a whole row or column is lit. Another benefit of the display of the present invention resides in the utilization of row and column drivers. Whereas a typical LCD requires a driver for each of the Red, Green and Blue channels of the display, a display of the present invention uses a single pixel well 70 (and hence grid) for all three colors. Combined with the aforementioned beam indexing, this means that the driver requirement is reduced by a factor of 3 relative to a comparable LCD. A further advantage is that, in active LCDs, conductive tracks must pass between semiconductor switches fabricated on the screen. Since the tracks do not emit light, their size must be limited so as not to be visible to a user. In displays of the present invention, all tracks are hidden either beneath phosphor 80 or on the underside of magnet 60. Due to the relatively large spaces between adjacent pixel wells 70, the tracks can be made relatively large. Hence capacitance effects can be easily overcome.

The relative efficiencies of phosphors 80 at least partially determines the drive characteristics of the gate structure. One way to reduce the voltages involved in operating a beam indexed system is to change the scanning convention. In a preferred embodiment of the present invention, rather than the usual scan of R G B R G B, . . . , the scan is organized so that the most inefficient phosphor is placed in between the two more efficient phosphors in a phosphor stripe pattern. Thus, if the most inefficient phosphor is, for example, Red, the scan follows the pattern B R G R B R G R . . . .

In a preferred embodiment of the resent invention, a standing DC potential difference is introduced across deflection anodes 50. The potential can be varied by potentiometer adjustment to permit correction of any residual misalignment between phosphors 80 and pixel wells 70. A two dimensional misalignment can be compensated by applying a varying modulation as the row scan proceeds from top to bottom.

Figure 10A:
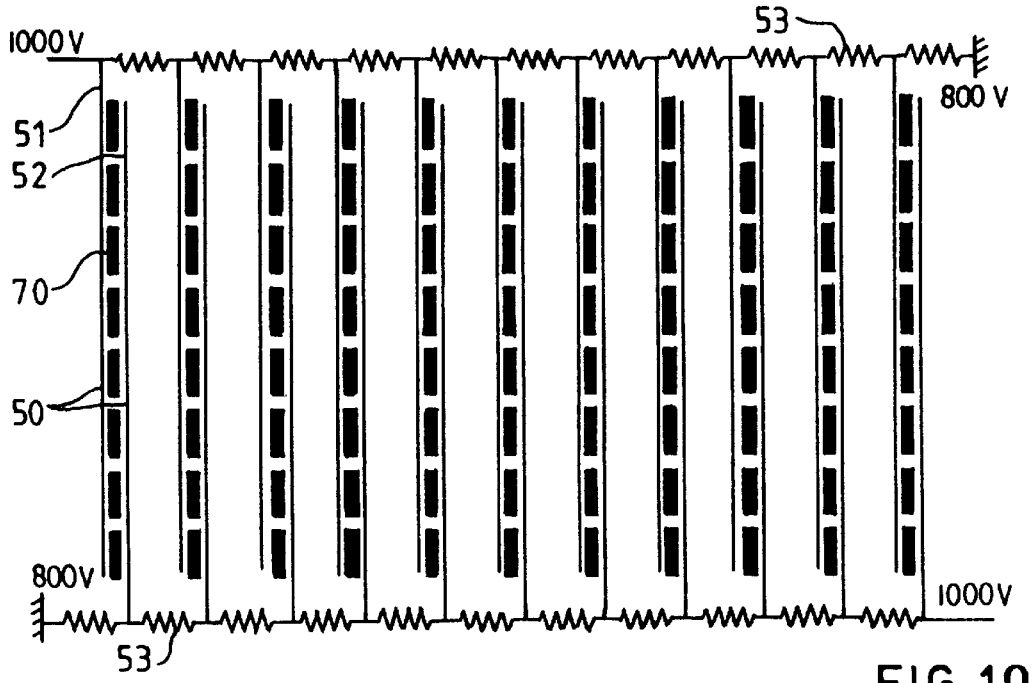
FIG. 10A, is a plan view of a display of the present invention.
Figure 10B:
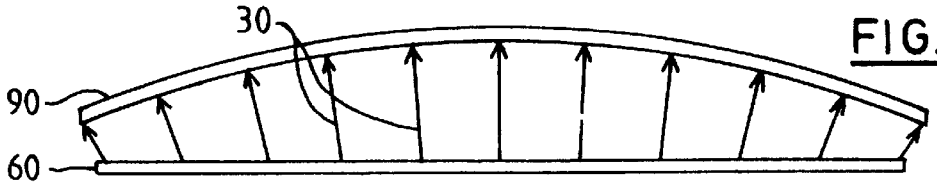
FIG. 10B, is a cross section through the display of FIG. 10A.

Referring now to FIG. 10*a*, in a preferred embodiment of the present invention, resistive elements 53 between deflection anodes 50 are made resistive. This introduces a slightly different DC potential from the centre to the edge of the display. The electron trajectory thus varies gradually in angle as shown in FIG. 10*b*. This permits a flat magnet 60 to be combined with non-flat glass 90 and, in particular, cylindrical glass. Cylindrical glass is preferable to flat glass because it relieves mechanical stress under atmospheric pressure. Flat screens tend to demand extra implosion protection when used in vacuum tubes.

As hereinbefore described, a preferred embodiment of the present invention involves a pixel addressing technique which differs from those employed in both CRT and LCD technologies. In conventional CRT displays, pixels are addressed by scanning an electron beam horizontally for a line of data and vertically for successive data lines. The actual period of phosphor excitation for single pixel is very short and the duration between successive excitations long, i.e.: the frame rate of the display. Thus the light output from each pixel is limited. Grey scale is achieved by varying the beam current density. In conventional active matrix LCDs, each pixel consists of three sub-pixels (Red, Green, and Blue) each with it's own switching transistor. Color selection can be based upon either row or column drive. Traditionally however, color selection is based on column drive. Video data from a video source is clocked into a shift register until one rows worth (i.e.: 640×3 sub-pixels for VGA graphics) has been accumulated. The data is then transferred in parallel to storage which also acts as a DAC for each column. Typically 3 bit and 6 bit DACs are employed. Row drivers select the row to be addressed. With 3 bits of grey-scale per color, 512 colors are available. This can be extended by one bit of temporal dither to 4096 colors. A further extension beyond 4096 colors can be introduced by software spatial dither. With 6 bits of grey scale per color, 262,144 colors are available, extended by software spatial dither. Light output is a function of back-light efficiency, polarization losses, cell aperture, and color filter transmission losses. Typically, transmission is only 4% efficient.

In a preferred embodiment of the present invention, color selection is performed by beam indexing. To facilitate such beam indexing, the line rate is 3 times faster than normal and the R, G, and B line is multiplexed sequentially. Alternatively, the frame rate may be 3 times faster than usual and field sequential color is employed. It should be appreciated that field-sequential scanning may produce objectionable visual effects to an observer moving relative to the display. Important features of a display of the present invention include the following.

1. Each pixel is generated by a single pixel well 70.
2. The color of a pixel is determined by a relative drive intensity applied to each of the three primary colors.
3. Phosphor 80 is deposited on faceplate 90 in stripes.
4. Primary colors are scanned via a beam index system which is synchronized to the grid control.
5. An electron beam is used to excite high voltage phosphors.
6. Grey-scale is achieved by control of the grid voltage at the bottom of each pixel well (and hence the electron beam density).
7. An entire row or column is addressed simultaneously.
8. If required, the least efficient phosphor 80 can be double scanned to ease grid drive requirements.
9. Phosphor 80 is held at a constant DC voltage.

The above features provide considerable advantages over conventional flat panel displays as will be described in the following, taking each in turn generally in the order presented above.

1. The pixel well concept reduces overall complexity of display fabrication.
2. Whereas in a CRT display, only about 11% of the electron beam current exits the shadow mask to excite the phosphor triads, in a display of the present invention the electron beam current at or near to 100% of the beam current is utilized for each phosphor stripe it is directed at by the beam indexing system. An overall beam current utilization of 33% is achievable, 3 times that achievable in a conventional CRT display.
3. Striped phosphors prevent Moire interference occurring in the direction of the stripes.
4. Control structures and tracks for the beam index system can be easily accommodated in a readily available area on top of the magnet, thereby overcoming a requirement for narrow and precise photolithography as is inherent in conventional LCDs.
5. High voltage phosphors are well understood and readily available.
6. The grid voltage controls an analog system.

Thus the effective number of bits for each color is limited only by the DAC used to drive grid 40. Since only one DAC per pixel well row is involved, and the time available for digital to analog conversion is very long, higher resolution in terms of grey-scale granularity is commercially feasible. Thus, the generation of "true color" (24 bits or more) is realizable at relatively low cost.

7. As with conventional LCDs, a display of the present invention uses a row/column addressing technique. Unlike conventional CRT displays however, the excitation time of the phosphor is effectively one third of the line period, e.g.: between 200 and 530 times longer than that for a CRT display for between 600 and 1600 pixels per line resolution. Even greater ratios are possible, especially at higher resolutions. The reason for this is that line and frame flyback time necessary when considering conventional CRT display are not needed for displays of the present invention. The line flyback time alone for a conventional CRT display is typically 20% of the total line period. Furthermore front and back porch times are redundant in displays of the present invention, thereby leading to additional advantage. Further benefits include:
   a) Only one driver per row/column is required ( conventional color LCDs need three);
   b) Very high light outputs are possible. In a conventional CRT display, the phosphor excitation time is much shorter than it's decay time. This means that only one photon per site is emitted during each frame scan. In a display of the present invention, the excitation time is longer than the decay period and so multiple photons per site are emitted during each scan. Thus, a much greater luminous output can be achieved. This is attractive both for projection applications and for displays to be viewed in direct sunlight.

c) The grid switching speeds are fairly low. It will be appreciated that, in a display of the present invention, the conductors formed on the magnet are operating in a magnetic field. Thus, the conductor inductance gives rise to an unwanted EMF. Reducing the switching speeds reduces the EMF, and also reduces stray magnetic and electric fields.

8. The grid drive voltage is related to the cost of the switching electronics. CMOS switching electronics offers a cheap possibility, but CMOS level signals are also invariably lower than those associated with alternative technologies such as bipolar, for example. Double scanning, e.g.: splitting the screen in half and scanning the 32 halves in parallel, as is done in LCDs, thus provides an attractively cheap drive technology. Unlike in LCD technology however, double scanning in a display of the present invention doubles the brightness.

9. In low voltage FEDS, phosphor voltages are switched to provide pixel addressing. At small phosphor strip pitches, this technique introduces significant electric field stress between the strips. Medium or higher resolution FEDs may not therefore be possible without risk of electrical breakdown. In displays of the present invention however, the phosphors are held at a single DC final anode voltage as in a conventional CRT display. In preferred embodiments of the present invention, an aluminum backing is placed on the phosphors to prevent charge accumulation and to improve brightness. The electron beams are sufficiently energetic to penetrate the aluminum layer and cause photon emission from the underlying phosphor.

Figure 11:
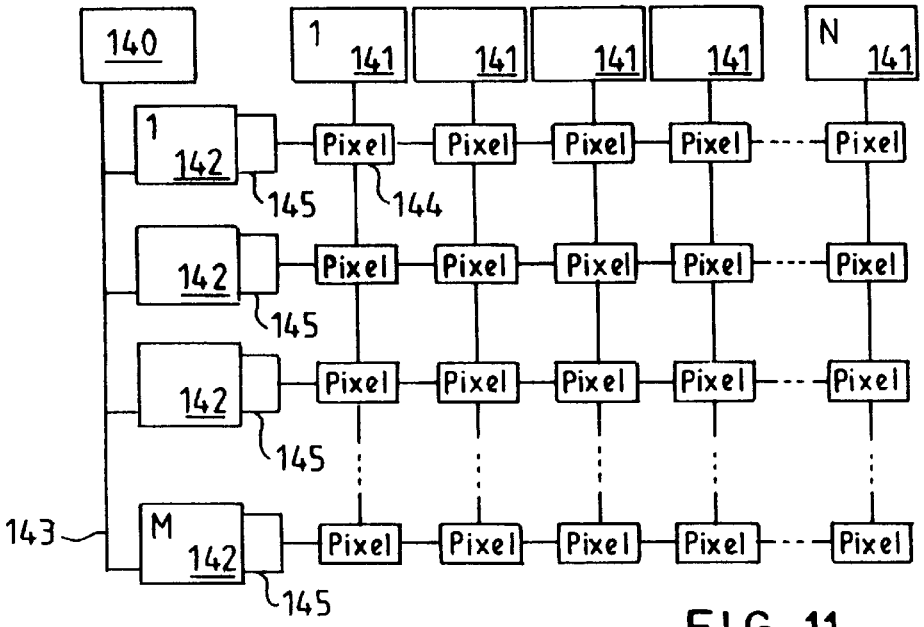
FIG. 11, is a block diagram of an addressing system for a display of the present invention.

Referring now to FIG. 11, a preferring matrix addressing system for an N×M pixel display of the present invention comprises an n bit data bus 143. A data bus interface 140 receives input red and blue video signals and places them on data bus in an n bit digital format, where p of each n bits indicates which of the M rows the n bits is addressed to. Each row is provided with an address decoder 142 connected to a q bit DAC, where p+q=n. In preferred embodiments of the present invention, q=8. The output of each DAC is connected to a corresponding row conductor of grid 40 associated with a corresponding row of pixels 144. Each column is provided with a column driver 141. The output of each column driver 141 is connected to corresponding column conductor of grid 40 associated with a corresponding column of pixels 144. Each pixel 144 is thus located at the intersection of a different combination of row and column conductors of grid 40.

Figure 12:
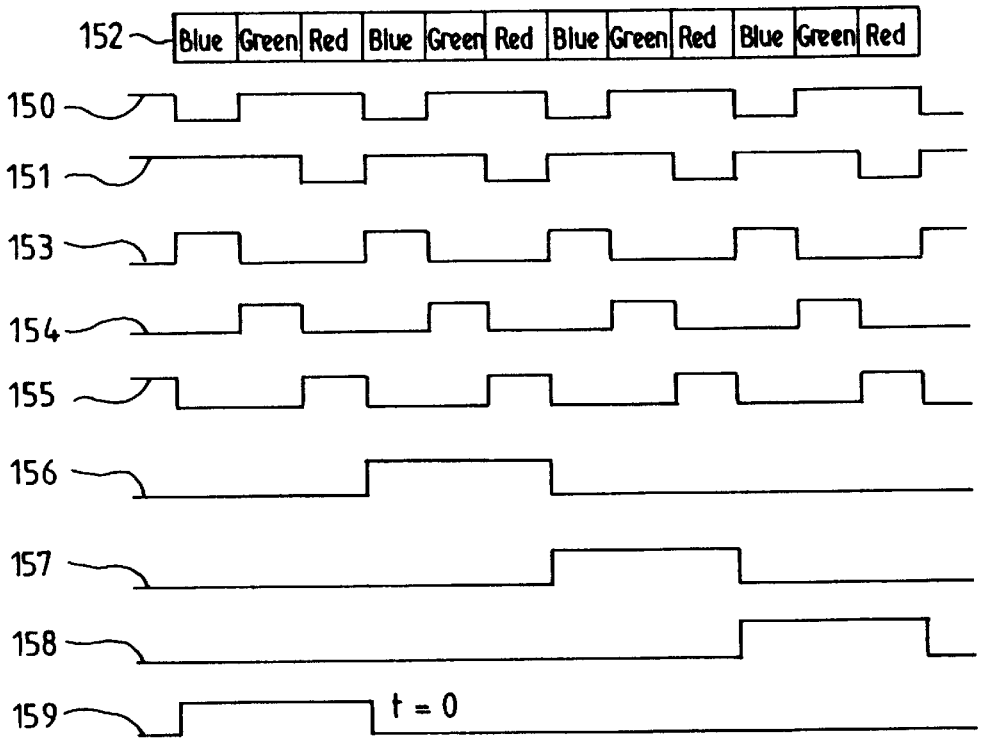
FIG. 12 is a timing diagram corresponding to the addressing system of FIG. 11.

Referring now to FIG. 12, in operation, anodes 51 and 52 are energized with waveforms 150 and 151 respectively to scan electron beam 30 from each pixel well 70 across Red, Green and Blue phosphor stripes 80 in the order shown at 152. Red, Green and Blue video data, represented by waveforms 153, 154, and 155, is sequentially gated onto the row conductors in synchronization with beam indexing waveforms 150 and 151. Column drivers 1, 2, 3 and N generate waveforms 156, 157, 158, and 159 respectively to sequentially select each successive pixel in given row.

Table 1 below compares a conventional CRT display with a display of the present invention for a 480×480 non-interlaced image refreshed 60 Hz. For the CRT image, a 5% vertical and a 25% horizontal blanking period is assumed.

TABLE 1

| CRT DISPLAY | | MAGNETIC MATRIX DISPLAY | |
|---|---|---|---|
| FRAME RATE | 60 Hz | FRAME RATE | 60 Hz |
| LINE RATE | 31.5 Hz | COLUMN SEQUENCING RATE | 38.4 kHz |
| PIXEL RATE | 25.8 MHz | DAC UPDATE RATE | 115.2 kHz |
| PHOSPHOR EXCITATION TIME | 38.7 nsec | PHOSPHOR EXCITATION TIME | 8.68 usec |
| DATA TRANSFER RATE (8 bit color) | 25.8M Bytes/sec | DATA TRANSFER RATE (8 bit color) | 18.4M Bytes/sec |

Table 2 below repeats the comparison of Table 1 for a 1280×1024 non-interlaced image at 100 Hz refresh rate.

TABLE 2

| CRT DISPLAY | | MAGNETIC MATRIX DISPLAY | |
|---|---|---|---|
| FRAME RATE | 100 Hz | FRAME RATE | 100 Hz |
| LINE RATE | 107.5 kHz | COLUMN SEQUENCING RATE | 128 kHz |
| PIXEL RATE | 172 MHz | DAC UPDATE RATE | 384 kHz |
| PHOSPHOR EXCITATION TIME | 5.813 nsec | PHOSPHOR EXCITATION TIME | 2.604 usec |
| DATA TRANSFER RATE (24 bit color) | 516M Bytes/sec | DATA TRANSFER RATE (24 bit color) | 393M Bytes/sec |

Note that the above figures relating to the display of the present invention are for single scanned central phosphor.

Figure 13:
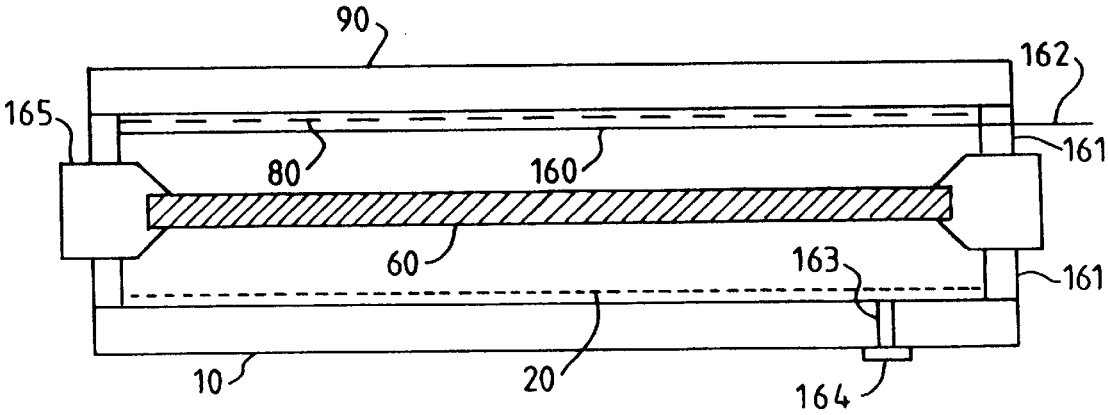
FIG. 13, is a cross section through a display of the present invention.

Referring now to FIG. 13, in a preferred embodiment of the present invention in which cathode means 20 is provided by field emission devices. Magnet 60 is supported by glass supports 165 through which connections to the row and column conductors of grid 40 are brought out. A connection 162 to the final anode 160 is brought out via glass side supports 161. The assembly is evacuated during manufacture via exhaust hole 163 which is subsequently capped at 164. A getter may be employed during evacuation to remove residual gases. In small, portable displays of the present invention, faceplate 90 may be sufficiently thin that spacers are fitted to hold faceplate 90 level relative to magnet 60. In larger displays, faceplate 90 can be formed from thicker, selfsupporting glass.

Figure 14A:
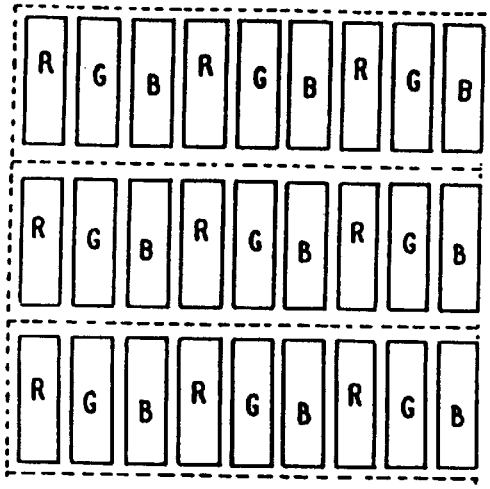
FIG. 14A is a plan view of a conventional pixel structure.

Referring now to FIG. 14A, in examples of the present invention hereinbefore described phosphors 80 are arranged in successive stripes of red, green, and blue phosphors. Each pixel of a displayed image is constituted by three sub-pixels. Each sub-pixel is provided by a phosphor stripe. It is desirable for each pixel to be square. Thus, it is desirable for each sub-pixel to be rectangular having a height to width or aspect ratio of at least 1:3 and a surface area and shape commensurate with the electron beam emerging from the corresponding well 70. In practice, the aspect ratio is higher still because of the aforementioned requirement to run anode tracks between adjacent well 70 in a row-wise direction on magnet 60. The rectangular sub-pixels produce two undesirable visual effects:

a. Referring to FIG. 14C, on primary colors (Red, Green, or Blue), the widths of vertical and horizontal lines are different; and, b. Referring now FIG. 14F, on secondary colors, particularly magenta, a convergence error is perceived because of the spacing between red and blue sub-pixels.

The above effects only disappear completely for white (or grey-scale) images.

Figure 14B:
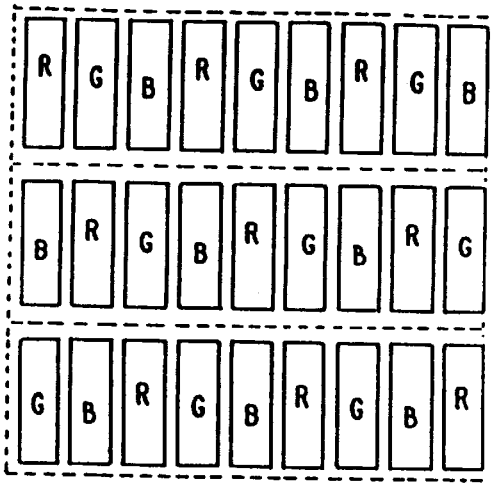
FIG. 14B is a plan view of a pixel structure of the present invention.
Figure 14C:
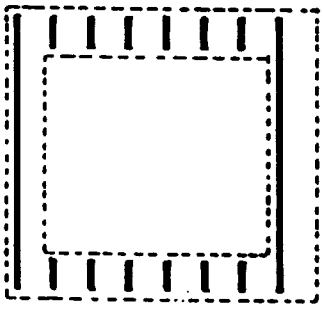
FIG. 14C is a primary color image produced by the conventional pixel structure of FIG. 14A.
Figure 14D:
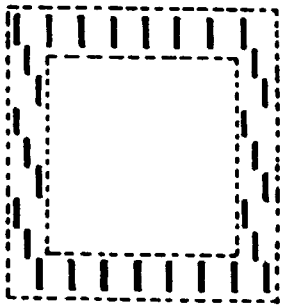
FIG. 14D is the image of FIG. 14C when produced by the pixel structure of FIG. 14B.
Figure 14E:
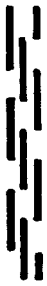
FIG. 14E is a secondary color line produced by the pixel structure of FIG. 14B; and, FIG. 14F is the line of FIG. 14E when produced by the conventional pixel structure of FIG. 14A.
Figure 14F:
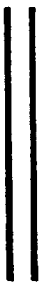

Referring to FIG. 14B, in a particularly preferred embodiment of the present invention, the above mentioned problems are solved by staggering the sub-pixel pattern in the column direction of the screen. It will be appreciated by reference to FIG. 14D that the staggered pixel structure produces vertical and horizontal primary color lines which are both of equal thickness. Likewise, with reference to FIG. 14E, it will be appreciated the staggered structure effectively removed the otherwise perceived convergence error. It will further be appreciated that, in order to scan the staggered sub-pixel structure with aforementioned beam indexing technique, some routine modification of the beam addressing mechanism is required.

Examples of magnetic matrix displays employing the present invention have been hereinbefore described. It will now be appreciated that such displays employ a combination of electrostatic and magnetic fields to control the path of high energy electrons in a vacuum. Such displays have a number of pixels and each is generated by it own site within the display structure. Light output is produced by the incidence of electrons on phosphor stripes. Both monochrome and color displays are possible. The color version uses a switched anode technique to perform beam indexing. It will also now be appreciated that the present invention is not limited to display technology in application and may be used in other technologies such as printer technology for example. In particular, it will be appreciated that the present invention can be arranged to act as a print head in document production and/or reproduction apparatus such as printers, copiers, or facsimile machines.

While the invention has been particularly shown and described with respect to (a) preferred embodiment(s) thereof, it will be understood by those skilled in the art that the foregoing and other changes in form and details may be made therein without departing from the spirit and scope of the invention.

Having thus described our invention, what we claim as new, and desire to secure by Letters Patent is:

1. An electron source comprising a cathode; a permanent magnet block perforated by a plurality of channels, each channel having a length larger than its width and extending between opposite poles of the magnet block, wherein, in each channel, a magnetic field acts upon electrons received from the cathode for a sufficient time to form an electron beam for guidance towards a target; and grid electrode means disposed between the cathode and the magnet block for selectively addressing different ones of the channels to control flow of electrons from the cathode towards the target through the selectively addressed channels.

2. An electron source as claimed in claim 1, wherein the channels are disposed in the magnet in a two dimensional array of rows and columns.

3. An electron source as claimed in claim 2, wherein the grid electrode means comprises a plurality of parallel row conductors and a plurality of parallel column conductors arranged orthogonally to the row conductors, each channel being located at a different intersection of a row conductor and a column conductor.

4. An electron source as claimed in claim 2, wherein the grid electrode means is disposed on the surface of the cathode means facing the magnet.

5. An electron source as claimed in claim 2, wherein the grid electrode means is disposed on the surface of the magnet facing the cathode means.

6. An electron source as claimed in claim 1, wherein the cathode means comprises a field emission device.

7. An electron source as claimed in claim 1, wherein the cathode means comprises a photocathode.

8. An electron source as claimed in claim 1, wherein each channel varies in cross-section along its length.

9. An electron source as claimed in claim 1, wherein the each channel is tapered, the end of the channel having the largest surface area facing the cathode means.

10. An electron source as claimed in claim 1, wherein the magnet comprises ferrite.

11. An electron source as claimed in claim 10, wherein the magnet comprises a binder.

12. An electron source as claimed in claim 11, wherein the binder comprises silicon dioxide.

13. An electron source as claimed in claim 1, wherein each channel is quadrilateral in cross-section.

14. An electron source as claimed in claim 13 wherein each channel is rectangular in cross-section.

15. An electron source as claimed in claim 13 wherein each channel is square in cross-section.

16. An electron source as claimed in claim 13 wherein the corners and edges of each channel are radiussed.

17. An electron source as claimed in claim 1, wherein the magnet comprises a stack of perforated laminations, the perforations in each lamination being aligned with the perforations in an adjacent lamination to continue the channel through the stack.

18. An electron source as claimed in claim 17, wherein each lamination in the stack is separated from an adjacent lamination by a spacer.

19. An electron source as claimed in claim 1, comprising an insulating layer deposited on at least one surface of the magnet.

20. An electron source as claimed in claim 1, comprising anode means disposed on the surface of the magnet remote from the cathode for accelerating electrons through the channels.

21. An electron source as claimed in claim 20, wherein the anode means comprises a plurality of anodes extending parallel to the columns of channels, the anodes comprising pairs of anodes each corresponding to a different column of channels, each pair comprising a first anode and a second anode respectively extending along opposite sides of the corresponding column of anodes, the first anodes being interconnected and the second anodes being interconnected.

22. An electron source as claimed in claim 21, wherein the first and second anodes comprise lateral formations surrounding corners of the channels.

23. An electron source as claimed in claim 22, comprising means for applying a deflection voltage across the first and second anodes to deflect electron beams emerging from the channels.

24. An electron source as claimed in claim 21, comprising means for applying a deflection voltage across the first and second anodes to deflect electron beams emerging from the channels.

25. An electron source as claimed in claim 1, wherein the channel length is at least twenty five times the channel width.

26. A display device comprising:

an electron source having cathode means, a permanent magnet perforated by a plurality of channels extending between opposite poles of the magnet wherein each channel forms electrons received from the cathode means into an electron beam for guidance towards a target, arid electrode means disposed between the cathode means and the magnet for selectively addressing different ones of the channels to control flow of electrons from the cathode means towards the target through the selectively addressed channels, and anode means disposed on the surface of the magnet remote from the cathode for accelerating electrons through the channels;

a screen for receiving electrons from the electron source, the screen having a phosphor coating facing the side of the magnet remote from the cathode; and means for supplying control signals to the grid electrode means and the anode means to selectively control flow of electrons from the cathode to the phosphor coating via the channels thereby to produce an image on the screen.

27. A display device comprising:

an electron source having cathode means, a permanent magnet perforated by a plurality of channels extending between opposite poles of the magnet wherein each channel forms electrons received from the cathode means into an electron beam for guidance towards a target, grid electrode means disposed between the cathode means and the magnet for selectively addressing different ones of the channels to control flow of electrons from the cathode means towards the target through the selectively addressed channels, and anode means disposed on the surface of the magnet remote from the cathode for accelerating electrons through the channels;

a screen for receiving electrons from the electron source, the screen having a phosphor coating facing the side of the magnet remote from the cathode, the phosphor coating comprising a plurality of groups of different phosphors, the groups being arranged in a repetitive pattern, each group corresponding to a different channel;

means for supplying control signals to the grid electrode means and the anode means to selectively control flow of electrons from the cathode to the phosphor coating via the channels; and deflection means for supplying deflection signals to the anode means to sequentially address electrons emerging from the channels to different ones of the phosphors for the phosphor coating thereby to produce a color image on the screen.

28. A display device as claimed in claim 27, wherein the phosphors comprise Red, Green, and Blue phosphors.

29. A display device as claimed in claim 28, wherein the deflecting means is arranged to address electrons emerging from the channels to different ones of the phosphors in the repetitive sequence Red, Green, Red, Blue.

30. A display device as claimed in claim 29, comprising a final anode layer disposed on the phosphor coating.

31. A display device as claimed in claim 30, wherein the screen is arcuate in at least one direction and each interconnection between adjacent first anodes and between adjacent second anodes comprises a resistive element.

32. A display device as claimed in claim 31, comprising means for dynamically varying a DC level applied to the anode means to align electrons emerging from the channels with the phosphor coating on the screen.

* * * * *

UNITED STATES PATENT AND TRADEMARK OFFICE

CERTIFICATE OF CORRECTION

PATENT NO. : 5,917,277

DATED : June 29, 1999

INVENTOR(S) : Andrew R. Knox, et al.

It is certified that error appears in the above-identified patent and that said Letters Patent is hereby corrected as shown below:

Column 6, line 39: "i n" should read --in--

Column 19, line 33, Claim 26: "arid" should read --grid--

Signed and Sealed this

Fourth Day of January, 2000

*Attest:*

*Attesting Officer*

*Acting Commissioner of Patents and Trademarks*